US009352385B2

(12) United States Patent
Lanver et al.

(10) Patent No.: US 9,352,385 B2
(45) Date of Patent: May 31, 2016

(54) CORE-SHEATH PARTICLE FOR USE AS A FILLER FOR FEEDER MASSES

(75) Inventors: Ulrich Lanver, Langenfeld (DE); Klaus Dieter Riemann, Wunstorf (DE); Jürgen Hübert, Langenhagen (DE); Hermann Lieber, Langenhagen (DE)

(73) Assignee: CHEMEX GmbH, Delligsen (DE)

( * ) Notice: Subject to any disclaimer, the term of this patent is extended or adjusted under 35 U.S.C. 154(b) by 698 days.

(21) Appl. No.: 12/531,652

(22) PCT Filed: Mar. 14, 2008

(86) PCT No.: PCT/EP2008/053114

§ 371 (c)(1),
(2), (4) Date: Dec. 14, 2009

(87) PCT Pub. No.: WO2008/113765

PCT Pub. Date: Sep. 25, 2008

(65) Prior Publication Data

US 2011/0315911 A1 Dec. 29, 2011

(30) Foreign Application Priority Data

Mar. 16, 2007 (DE) ..... 10 2007 012 660

(51) Int. Cl.
*C09K 3/00* (2006.01)
*B22D 7/10* (2006.01)
*B22C 9/08* (2006.01)

(52) U.S. Cl.
CPC ..... *B22D 7/102* (2013.01); *B22C 9/084* (2013.01); *B22C 9/088* (2013.01)

(58) Field of Classification Search
None
See application file for complete search history.

(56) References Cited

U.S. PATENT DOCUMENTS

| | | | | |
|---|---|---|---|---|
| 2,624,556 | A * | 1/1953 | Kistler | 165/185 |
| 6,114,410 | A * | 9/2000 | Betzold | 523/130 |
| 6,972,059 | B1 | 12/2005 | Skerdi | |
| 7,770,629 | B2 * | 8/2010 | Weicker et al. | 164/528 |
| 2002/0070020 | A1 * | 6/2002 | Nguyen | 166/295 |
| 2003/0032701 | A1 * | 2/2003 | Gough | 523/218 |
| 2005/0016711 | A1 * | 1/2005 | Aufderheide et al. | 164/359 |
| 2008/0029240 | A1 | 2/2008 | Gerlach | |
| 2008/0099180 | A1 | 5/2008 | Weicker et al. | |
| 2009/0032210 | A1 * | 2/2009 | Skerdi et al. | 164/131 |

FOREIGN PATENT DOCUMENTS

| | | |
|---|---|---|
| DE | 2121353 | 11/1972 |
| DE | 19925167 | 12/2000 |
| DE | 102004042535 | 3/2006 |
| DE | 102005025771 | 12/2006 |
| EP | 0804980 | 11/1997 |
| EP | 0888199 | 10/2002 |
| EP | 0913215 | 10/2003 |
| EP | 1832357 | 9/2007 |
| EP | 1884300 | 2/2008 |
| JP | 117925 | 5/1996 |
| WO | WO 94/23865 | 10/1994 |
| WO | WO 98/29208 | 7/1998 |
| WO | WO 2006/058347 | 6/2006 |
| WO | WO 2006097278 A1 * | 9/2006 |

OTHER PUBLICATIONS

Machine Translation of DE 2121353.*

* cited by examiner

*Primary Examiner* — Alexandre Ferre
(74) *Attorney, Agent, or Firm* — Duane Morris LLP; Gregory M. Lefkowitz

(57) ABSTRACT

The present invention relates to a core-sheath particle for use as filler for feeder compositions for the production of feeders, comprising (a) a carrier core which
has a size within a range of from 30 μm to 500 μm
and
consists of a material which is maximally resistant up to a temperature of 1400° C. and does not contain any polystyrene, (b) a sheath which encloses the core and consists of or comprises (b1) particles having a D 50 value for the particle size of at most 15 μm, which are resistant up to a temperature of at least 1500° C.,
and (b2) a binder which binds the particles to one another and to the carrier core, the core-sheath particle being resistant up to a temperature of at least 1450° C.

20 Claims, No Drawings

CORE-SHEATH PARTICLE FOR USE AS A FILLER FOR FEEDER MASSES

CROSS-REFERENCE TO RELATED APPLICATIONS

This application is a §371 national stage entry of International Application No. PCT/EP2008/053114, filed Mar. 14, 2008, which claims priority to German Application No. 10 2007 012 660.5, filed Mar. 16, 2007, both of which are hereby incorporated by reference in their entirety.

FIELD OF THE INVENTION

The present invention relates to core-sheath particles for use as filler for feeder compositions for the production of feeders, to a corresponding free-flowing filler material comprising a multitude of core-sheath particles according to the invention, to a process for the preparation of core-sheath particles according to the invention or of free-flowing filler materials according to the invention, to corresponding feeder compositions and corresponding feeders as well as to corresponding applications. The following description and the accompanying claims reveal further subject-matters of the present invention.

In the context of the present documents, the term "feeder" includes feeder sheathings, feeder inserts and feeder caps as well as heating pads.

BACKGROUND OF THE INVENTION

During the production of metallic moldings in the foundry, liquid metal is poured into a mold where it then solidifies. The solidification procedure is associated with a reduction in the metal volume and for this reason, feeders, i.e. open or closed spaces in or on the mold are routinely used in order to compensate for the deficit in volume when the cast part solidifies and to thus prevent a shrinkage cavity from forming in the cast part. Feeders are associated with the cast part or with the cast part region which is at risk and are usually located above and/or on the side of the mold cavity.

In feeder compositions for the production of feeders and in the feeders themselves produced therefrom, light fillers are regularly used today which should produce a good insulating effect with a high temperature resistance.

DE 10 2005 025 771 B3 discloses insulating feeders comprising ceramic hollow spheres and glass hollow spheres.

EP 0 888 199 B1 describes feeders which contain hollow aluminum silicate microspheres as an insulating fire-resistant material.

EP 0 913 215 B1 discloses feeder compositions which comprise hollow aluminum silicate microspheres having an aluminum oxide content of less than 38% by weight.

WO 9423865 A1 discloses a feeder composition comprising hollow microspheres containing aluminum oxide with an aluminum oxide proportion of at least 40% by weight.

WO 2006/058347 A2 discloses feeder compositions which comprise as fillers core-sheath microspheres with a polystyrene core. However, the use of polystyrene results in undesirable emissions during casting.

DETAILED DESCRIPTION OF THE INVENTION

In industrial practice, hollow spheres are frequently used at present which originate from the fly ash of coal-fired power stations or are produced synthetically. However, hollow spheres which are suitable for use in feeders are not freely available. Therefore, it was the object of the present invention to provide a light filler which can be used as a substitute for the presently favored hollow spheres. The light filler to be specified should satisfy the following primary requirements:

- thermal stability even at temperatures of more than 1450° C., preferably at temperatures of more than 1500° C.;
- adequate mechanical stability even at elevated temperatures of, for example, 1400° C.;
- low or no dust adhesion;
- low bulk density.

The object set is achieved according to the invention by core-sheath particles for use as filler for feeder compositions for the production of feeders, comprising (a) a carrier core which has a size within a range of from 30 μm to 500 μm and consists of a material which is maximally resistant up to a temperature of 1400° C. and does not contain any polystyrene, (b) a sheath which encloses the core and consists of or comprises (b1) particles having a D 50 value for the particle size of at most 15 μm, preferably at most 10 μm, which are resistant up to a temperature of at least 1500° C., preferably at least 1600° C., and (b2) a binder which binds the particles to one another and to the carrier core, the core-sheath particle being resistant up to a temperature of at least 1450° C., preferably at least 1500° C.

The invention is based on the understanding that, by sheathing carrier materials (used as a carrier core) having a temperature resistance which is inadequate, for example for use as filler in feeder compositions, it is possible to convert them into core-sheath particles which are resistant up to a temperature of at least 1450° C., but usually at least 1500° C. For this purpose, it is necessary to sheath the carrier core with particles which have a D 50 value for the particle size of at most 15 μm and which, considered per se, are resistant up to a temperature of at least 1500° C., preferably 1600° C.

In the core-sheath particles according to the invention, the carrier core has a size, i.e. a maximum length ranging from 30 μm to 500 μm; it consists of a material which is maximally resistant up to a temperature of 1400° C. and does not contain any polystyrene, preferably no organic constituents at all, but preferably only inorganic constituents. The carrier core is preferably spherical.

Within the context of the present text, a particle or material is considered to be resistant if, under a given temperature, it neither melts nor softens or decomposes with the loss of its spatial shape.

The carrier core (a) of a core-sheath particle according to the invention preferably consists of a ceramic or glass material.

The carrier core (a) is preferably a hollow sphere or a porous particle, in which case the hollow sphere or porous particle in turn preferably consists of a ceramic or glass material. Examples of preferred materials which can be used as carrier core (a) are fine-pored foam glasses, as can be obtained, for example under the name Poraver from Dennert Poraver GmbH or, for example under the name Omega-Bubbles from Omega Minerals Germany GmbH and glass hollow microspheres, as can be obtained under the name 3M Scotchlite K20 by 3M Specialty Materials.

In the core-sheath particles according to the invention, the mentioned particles (b1) of the sheath (b) preferably comprise one or more materials or consist of one or more materials selected from the group of fire-resistant materials (to DIN 51060), preferably from the group consisting of: aluminum oxide, boron nitride, silicon carbide, silicon nitride, titanium boride, titanium oxide, yttrium oxide and zirconium oxide and mixed oxides, for example cordierite or mullite.

In the core-sheath particles according to the invention, the binder (b2) is preferably selected from the group consisting of:

- cold box binders, preferably a polyurethane which can be produced from a benzyl ether resin and a polyisocyanate,
- hot box binders,
- starch,
- polysaccharides, and
- water glass.

Core-sheath particles according to the invention can be used in fire-resistant compositions or materials, for example such as those for use in industrial furnace construction or to improve the fireproofing in buildings. They can also be used in or as heat insulation materials, for example in the construction industry or in the foundry industry.

The core-sheath particles according to the invention are preferably constituents of a free-flowing filler material which is suitable for use as filler for feeder compositions to produce feeders. A free-flowing filler material of this type according to the invention routinely comprises a multitude of core-sheath particles according to the invention (the comments made above applying in respect of the preferred configuration of the core-sheath particles) and optionally further filler substances.

In a free-flowing filler material according to the invention, the carrier cores (a) in the multitude of the core-sheath particles considered per se preferably have an average particle size MK within a range of from 60 μm to 380 μm. In this respect, the average particle size is determined according to the VDG data sheet P27 (October 1999).

The bulk density, considered per se, of the particles used as carrier cores is preferably within a range of from 85 g/L to 500 g/L. The bulk density of the carrier cores (a) is preferably determined before the cores are sheathed with the particles (b1) and the binder (b2) and optionally further constituents of the sheath. In the free-flowing filler material according to the invention, preferably at least 90% by weight of particles (b1) in the multitude of the core-sheath particles, based on the total weight of particles (b1) have a particle size of at most 45 μm. Accordingly, to coat the carrier cores (a), in particular pulverulent (i.e. fine, poly-disperse) bulk materials are suitable in which more than 90% by weight of the particles contained in the powder have a maximum particle size of 45 μm. The particle size of the particles in a corresponding powder is determined by dispersion photometers, for example by means of a Coulter dispersion photometer. A D50 value corresponding to an average particle size is frequently given as a further characteristic number. A selection of powders which are particularly suitable as sheath material (coating material) for sheathing the carrier cores is summarized in the following table:

| | Al203 | BN | SiC | Si3N4 | TiB2 | TiO2 | Y203 | ZrO2 |
|---|---|---|---|---|---|---|---|---|
| Melting point [° C.] | approx. 2050 | approx. 3000 | approx. 2300 Decomp. | approx. 1900 Decomp. | approx 2900 | approx 1850 | approx. 2410 | approx. 2600 |
| Max/ μm | <45 | | | <10 | <45 | <45 | | <45 |
| D 50/ μm | approx. 12 | approx. 9 | approx. 5 | approx. 1.5 | | | approx 6.5 | |

"max" means 90% by weight of the particles contained in the powder concerned have a particle size below the stated value.
"Decomp." means: decomposition.

A free-flowing tiller material according to the invention preferably has a bulk density of less than 0.6 g/cm$^3$ (i.e. 600 g/L), or a bulk density of less than 0.5 g/cm$^3$. A free-flowing filler material according to the invention which comprises core-sheath particles according to the invention can be produced by mixing carrier cores (a) with the (fire-resistant) powder of particles (b1) in the presence of a binder (b2). In a corresponding process according to the invention for the preparation of core-sheath particles according to the invention or for the preparation of a free-flowing filler material according to the invention, the following steps are carried out:

- the preparation of carrier cores of a size within a range of from 30 μm to 500 μm consisting of a material which is maximally resistant up to a temperature of 1400° C.,
- the preparation of particles of an average particle size of at most 15 μm, preferably at most 10 μm which are resistant up to a temperature of at least 1500° C., preferably at least 1600° C.,
- the contacting of the carrier cores with the mentioned particles in the presence of a binder so that the particles are bound to the carrier core and to one another and individual carrier cores or all the carrier cores are sheathed.

In respect of the physical form of preferred carrier cores, preferred particles and preferred binders, the statements made above in view of the core-sheath particles according to the invention and the filler materials according to the invention apply accordingly.

The present invention also relates to a feeder composition for the production of feeders, consisting of or comprising: core-sheath particles according to the invention (as described above, preferably in a form indicated as being preferred) or a free-flowing filler material according to the invention (as described above, preferably in a form indicated as being preferred) and a binder for binding the core-sheath particles or the free-flowing filler material. In respect of the binder, the statements made above concerning preferred binders for the core-sheath particles apply accordingly; it is preferable if, for binding the core-sheath particles (a) with the particles (b1) and for binding the core-sheath particles or the free-flowing material, a cold box binder (preferably based in each case on a benzyl ether resin and a polyisocyanate), more preferably an identical binder is used.

A feeder composition according to the invention can be configured as an exothermic feeder composition and, in this case, routinely comprises, in addition to the mentioned constituents, a readily oxidizable metal and an oxidizing agent therefor, which are intended to react exothermically with one another.

The present invention also relates to feeders which comprise a feeder composition according to the invention. Feeders according to the invention preferably have a density of less than 0.7 g/cm$^3$.

Further aspects of the present invention relate to the use of core-sheath particles according to the invention (as described above, preferably in a form indicated as being preferred) or of free-flowing filler material according to the invention (as described above, preferably in a form indicated as being preferred) as insulating filler material in a feeder composition or in a feeder.

Furthermore, the present invention also relates to the use of a feeder composition according to the invention for the production of an insulating or exothermic feeder.

To produce a feeder according to the invention, core-sheath particles according to the invention or a free-flowing filler material according to the invention, a suitable binder according to the invention (for example a cold box binder, see above) and optionally further constituents are mixed together, the resulting mixture is molded into a feeder and the molded feeder is cured. The molding procedure preferably rakes place according to the slurry process, the green bonding process, the cold box process or the hot box process.

The invention will be explained in detail in the following based on examples.

A Preparation of Core-Sheath Particles According to the Invention (Bulk Material)

Practical Example 1

700 g of Poraver (standard particle size 0.1-0.3; Dennert Poraver GmbH) as carrier material are introduced into a mixer of type BOSCH Profi 67 and uniformly wetted with 120 g of cold box binder (produced by Hüttenes-Albertus: benzyl ether resin based on Activator 6324/gas resin 6348). 300 g of silicon carbide powder (D 50 value for particle size: <5 μm) are added and the mixture is mixed homogeneously. Approximately 0.5 ml of dimethylpropylamine is finally added to cure the binder. After a few seconds, the core-sheath particles which have formed are present as bulk material for further use.

Practical Example 2

As carrier material, 800 g of Omega-Bubbles (produced by Omega Minerals GmbH; particle size <0.5 mm) are introduced as the carrier core into a suitable mixer of type BOSCH Profi 67 and uniformly wetted with 120 g of cold box binder (produced by Hüttenes-Albertus: benzyl ether resin based on Activator 6324/gas resin 6348). 200 g of aluminum oxide powder (D 50 value for particle size: approximately 12 μm) are added and the mixture is mixed homogeneously. Approximately 0.5 ml of dimethylpropylamine is finally added to cure the binder. After a few seconds, the core-sheath particles which have formed are present as bulk material for further use.

B Preparation of Feeder Compositions as Well as Feeder Caps and Other Profiled Bodies:

"Insulating" Practical Example

The bulk material prepared according to Example 1 respectively Example 2 is mixed homogenously with cold box binder (produced by Hüttenes-Albertus: benzyl ether resin based on Activator 6324/gas resin 6348). Feeder caps and other profiled bodies (a) are stamped out of the resulting mixture and (b) are shot with core shooters (for example Roper, Laempe). The products are cured in each case by adding dimethylpropylamine.

"Exothermic-Insulating" Practical Example

A mixture of 30 parts by weight of the bulk material prepared according to Example 1 respectively Example 2 and 70 parts by weight of a conventional aluminothermic mixture is mixed homogeneously with cold box binder (produced by Hüttenes-Albertus: benzyl ether resin based on Activator 6324/gas resin 6348). Feeder caps and other profiled bodies (a) are stamped out of the resulting mixture and (b) are shot with core shooters (for example Roper, Laempe). The products are cured in each case by adding dimethylpropylamine.

C Cube Tests:

Feeder caps according to the Practical Examples from B were performance tested for their usability using so-called cube tests. In these tests, a cast part in the form of a cube should be free from cavities using a module-compatible feeder cap.

A relatively reliable sealed feed could be demonstrated for all embodiments ("insulating", Practical Examples 1 and 2; "exothermic-insulating"; Practical Examples 1 and 2). A cavity behavior which was improved compared to comparative feeder caps was also established in each case in the respective remaining feeders (above the cubes).

The invention claimed is:

1. Feeder comprising a cured feeder composition,
said cured feeder composition comprising:
a multitude of core-sheath particles being resistant up to a temperature of at least 1500° C.,
wherein said core-sheath particles comprise:
(a) a carrier core which has a size within a range of from 30 μm to 500 μm and is formed of a material which is resistant up to a temperature of at most 1400° C.
and does not contain any polystyrene,
wherein the carrier core (a) consists of glass material and
wherein the carrier core (a) is a hollow sphere or a porous particle,
(b) a sheath which encloses the core and consists of or comprises
(b1) particles having a D50 value for the particle size of at most 10 μm,
which are resistant up to a temperature of at least 1600° C.,
wherein the particles (b1) consist of one or more materials selected from the group consisting of aluminum oxide, silicon carbide and mullite
and
(b2) a cured binder that binds the particles (b1) to one another and to the carrier core (a), wherein said binder is a polyurethane cold box binder
and
a cured binder binding the core-sheath particles together, wherein said binder is identical to the binder (b2).

2. The feeder according to claim 1, wherein said carrier core (a) is formed of fine-pored foam glass.

3. The feeder according to claim 1, wherein said binder (b2) is a polyurethane cold box binder produced from a benzyl ether resin and a polyisocyanate.

4. The feeder according to claim 1, having a density of 0.7 g/cm$^3$ or less.

5. The feeder according to claim 1, wherein said feeder composition further comprises a readily oxidizable metal and an oxidizing agent therefore, for the exothermic reaction with one another.

6. The feeder according to claim 1, wherein said particles (b1) are resistant up to a temperature of at least 1850° C.

7. The feeder according to claim 6, wherein said particles (b1) consist of one or more materials selected from the group consisting of aluminum oxide and silicon carbide.

8. The feeder according to claim 7, wherein said particles (b1) consist of aluminum oxide and are resistant up to a temperature of at least 2050° C.

9. The feeder according to claim 7, wherein, said particles (b1) consist of silicon carbide and are resistant up to a temperature of at least 2300° C. and have a D50 value for the particle size of approximately 5 μm.

10. The feeder according to claim 1, wherein:

said carrier core (a) is formed of fine-pored foam glass;

said particles (b1) are resistant up to a temperature of at least 1850° and consist of one or more materials selected from the group consisting of aluminum oxide and silicon carbide; and said binder (b2) is a polyurethane cold box binder produced from a benzyl ether resin and a polyisocyanate.

11. The feeder according to claim 10, wherein said particles (b1) consist of aluminum oxide and are resistant up to a temperature of at least 2050° C.

12. The feeder according to claim 10, wherein said particles (b1) consist of silicon carbide and are resistant up to a temperature of at least 2300° C. and have a D50 value for the particle size of approximately 5 μm.

13. The feeder according to claim 10, having a density of 0.7 g/cm$^3$ or less.

14. The feeder according to claim 10, wherein the feeder composition further comprises a readily oxidizable metal and an oxidizing agent therefore, for the exothermic reaction with one another.

15. Process for producing a feeder according to claim 1, comprising:

molding a feeder composition into a feeder, wherein the feeder composition comprises a multitude of core-sheath particles being resistant up to a temperature of at least 1500° C., wherein said core-sheath particles comprise:

(a) a carrier core which has a size within a range of from 30 μm to 500 μm and is formed of a material which is resistant up to a temperature of at most 1400° C. and does not contain any polystyrene, wherein the carrier core (a) consists of glass material and wherein the carrier core (a) is a hollow sphere or a porous particle, (b) a sheath which encloses the core and consists of or comprises (b1) particles having a D50 value for the particle size of at most 10 μm, which are resistant up to a temperature of at least 1600° C., wherein the particles (b1) consist of one or more materials selected from the group consisting of aluminum oxide, silicon carbide and mullite and (b2) a cured binder that binds the particles (b1) to one another and to the carrier core (a), wherein said binder is a polyurethane cold box binder, and a curable binder for binding the core-sheath particles together, wherein said binder is identical to the binder (b2);

and curing the molded feeder.

16. The process according to claim 15, wherein molding takes place according to the cold-box process.

17. The process according to claim 15, wherein said feeder is cured by adding dimethylpropylamine.

18. The process according to claim 15, wherein said particles (b1) are resistant up to a temperature of at least 1850° C.

19. The process according to claim 15, wherein said feeder has a density of 0.7 g/cm$^3$ or less.

20. The process according to claim 15, wherein said feeder is an exothermic feeder.

* * * * *